US005415980A

United States Patent [19]

Ohshima

[11] Patent Number: 5,415,980

[45] Date of Patent: May 16, 1995

[54] IMAGE FORMING METHOD

[75] Inventor: Naoto Ohshima, Kanagawa, Japan

[73] Assignee: Fuji Photo Film Co., Ltd., Kanagawa, Japan

[21] Appl. No.: 217,762

[22] Filed: Mar. 25, 1994

Related U.S. Application Data

[63] Continuation of Ser. No. 800,079, Nov. 29, 1991, abandoned.

[30] Foreign Application Priority Data

Nov. 30, 1990 [JP] Japan ..... 2-334787

[51] Int. Cl.[6] ..... G03C 7/46

[52] U.S. Cl. ..... 430/376; 430/502; 430/377; 430/380; 430/550; 430/588; 430/585; 430/605; 430/567; 430/374

[58] Field of Search ..... 430/502, 377, 380, 376, 430/550, 588, 585, 605, 567, 374

[56] References Cited

U.S. PATENT DOCUMENTS

| | | | |
|---|---|---|---|
| 5,004,675 | 4/1991 | Yoneyama et al. | 430/377 |
| 5,093,226 | 3/1992 | Ohshima | 430/377 |
| 5,108,877 | 4/1992 | Asami | 430/377 |
| 5,114,837 | 5/1992 | Ogawa | 430/504 |
| 5,154,995 | 10/1992 | Kawai | 430/503 |
| 5,198,328 | 3/1993 | Shiba et al. | 430/376 |

FOREIGN PATENT DOCUMENTS 0096149 4/1990 Japan .

*Primary Examiner*—Thomas R. Neville
*Attorney, Agent, or Firm*—Sughrue, Mion, Zinn, Macpeak & Seas

[57] ABSTRACT

A method of forming a photographic image comprising imagewise exposing a silver halide color photographic material comprising a support having thereon a cyan color image forming layer, a magenta color image forming layer and an yellow color image forming layer, wherein the cyan color image forming layer in the photographic material contains silver halide emulsion grains having a silver chloride content of 95 mol % or more and containing substantially no silver iodide and contains a color sensitizing dye of the following general formula (I), (I)

wherein the terms are as defined in the specification and color developing the exposed material with a color developer, wherein the color developer has a chloride ion content of from $3.5\times10^{-2}$ to $1.5\times10^{-1}$ mol/liter and a bromide ion content of from $1.5\times10^{-5}$ to $1.0\times10^{-3}$ mol/liter.

6 Claims, No Drawings

IMAGE FORMING METHOD

This is a continuation of application No. 07/800,079 filed Nov. 29, 1991 now abandoned.

FIELD OF THE INVENTION

The present invention relates to an image forming method and, more precisely, to a method of forming a photographic image using a high silver chloride photographic material by rapid photographic processing, in which the material is hardly fogged and may be processed quite well with a fatigued color developer or by continuous processing while noticeably inhibition in the fluctuation of the sensitivity and gradation of the material being processed is achieved.

BACKGROUND OF THE INVENTION

Recently, photographic processing of color photographic materials has involved reducing the processing time to shorten the time for delivery of finished photo prints and have involved reducing the labor of photo laboratories. One method of shortening the time of the respective processing steps involves elevating the processing temperature in each step in general. In addition, other various methods of enhancing stirring of the processing solutions and adding various promoters to the processing bathes have been proposed.

Above all, to promote color development and/or reduce the amount of replenisher to be added in the development step, it is known to process a color photographic material containing a silver chloride emulsion, in place of a silver bromide emulsion or silver iodide emulsion which has heretofore been widely used. For instance, International Patent Laid-Open Application WO87-04534 describes a method of processing a silver halide color photographic material having a high silver chloride content or a so-called high silver chloride color photographic material with a color developer substantially containing neither sulfite ion nor benzyl alcohol.

However, it has been found that development of this type of material with an automatic color paper developing machine in accordance with the above-described method causes fluctuation of the photographic properties (especially, the minimum density) of the processed material and noticeable stain in the white background of the processed material.

Rapid development of a high silver chloride color photographic material thus involves a serious problem of fluctuation of the photographic properties of the processed material, and solution of the problem has been desired strongly.

One method of processing a high silver chloride color photographic material by rapid continuous processing with reducing fluctuation of the photographic properties (especially, fog) of the processed material involves use of an organic anti-foggant as disclosed in JP-A-58-95345 and 59-232342. (The term "JP-A" as used herein means an "unexamined published Japanese patent application".) However, the anti-fogging effect of the organic anti-foggant has been found to be insufficient so that use of the agent does not fully prevent an increase in the minimum density of the processed material using continuous processing. If a large amount of the agent is used in this method, it has further been found that such a large amount of the agent rather causes a decrease in the maximum density of the processed material.

JP-A-61-70552 discloses a method of processing a high silver chloride color photographic material by adding a replenisher to the developer in such an amount that the added replenisher does not cause overflow from the developer bath for the purpose of reducing the amount of the replenisher added in the method. JP-A-63-106655 discloses a method of developing a silver halide color photographic material having high silver chloride emulsion layer(s) with a color developer containing a hydroxylamine compound and a chloride, with the concentration of the chloride being more than a determined one, where the object is stabilizing the processing procedure.

However, it has been found that both of these prior art methods still result in fluctuation of the photographic properties of the processed material in continuous processing with an automatic developing machine. Anyway, the methods could not overcome the above-mentioned problem.

JP-A-2-96149 illustrates a continuous processing technique capable of noticeably decreasing the fluctuation in the minimum density of a processed silver halide photographic material in which a particular pentamethine cyanine dye is added to the material as a sensitizing dye and the chloride ion concentration and the bromide ion concentration in the color developer used are specifically defined. JP-A-2-96148 also illustrates another continuous processing technique for noticeably decreasing the fluctuation in the minimum density of a processed silver halide photographic material in which the silver bromide content in the silver halide emulsion of the material is specifically defined and the chloride ion concentration and the bromide ion concentration in the color developer used are specifically defined.

With this background, the present inventors conducted further investigations in this area and, as a result, they have found that the above-described techniques could be effectively used to noticeably decrease fluctuation in the minimum density of the processed photographic materials in continuous processing but they are not always sufficient to prevent fluctuation of the sensitivity and gradation of the processed photographic materials in continuous processing.

SUMMARY OF THE INVENTION

An object of the present invention is to provide a method of forming a photographic image with a high silver chloride photographic material by rapid photographic processing, in which the material is hardly fogged and may be processed well even with a fatigued color developer or by continuous processing with the fluctuation of the sensitivity and gradation of the material being processed being noticeably inhibited.

The object of the present invention is attained by a method of forming a photographic image comprising imagewise exposing a silver halide color photographic material comprising a support having thereon a cyan color image forming layer, a magenta color image forming layer and an yellow color image forming layer, wherein the cyan color image forming layer in the material contains silver halide emulsion grains having a silver chloride content of 95 mol % or more and having substantially no silver iodide and contains a color sensitizing dye of the following general formula (I),

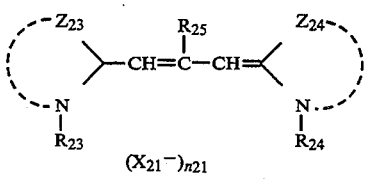

(I)

wherein $Z_{23}$ and $Z_{24}$ independently represent an atomic group necessary for forming a heterocyclic nucleus selected from the group consisting of a benzothiazole nucleus, a benzoselenazole nucleus, a naphthothiazole nucleus and a naphthoselenazole nucleus, which may optionally be substituted by at least one substituent selected from the group consisting of a halogen atom, an alkyl group, an alkoxy group, an aryl group and a hydroxyl group;

$R_{25}$ represents a hydrogen atom, a substituted or unsubstituted alkyl group or a substituted or unsubstituted aryl group;

$R_{23}$ and $R_{24}$ independently represent a substituted or unsubstituted alkyl group;

$X_{21}$ represents an ion present for neutrality;

$n_{21}$ represents 0 or 1; and when one of $R_{23}$ and $R_{24}$ forms an internal salt together with a quaternized nitrogen atom, $n_{21}$ is 0; and color developing the exposed material with a color developer where the color developer has a chloride ion content of from $3.5\times10^{-2}$ to $1.5\times10^{-1}$ mol/liter and a bromide ion content of from $1.5\times10^{-5}$ to $1.0\times10^{-3}$ mol/liter.

DETAILED DESCRIPTION OF THE INVENTION

In formula (I), $Z_{23}$ and $Z_{24}$ each form a heterocyclic nucleus which may optionally be substituted by one or more substituents. Preferred examples of such substituents are a halogen atom such as fluorine, chlorine and bromine atoms; an alkyl group having 4 carbon atoms or less, such as methyl, ethyl and propyl groups; an alkoxy group having 4 carbon atoms or less, such as methoxy, ethoxy and propoxy groups; and an aryl group having 7 carbon atoms or less, such as phenyl and p-tolyl groups. $R_{25}$ is preferably a hydrogen atom; or a substituted or unsubstituted alkyl group having 8 carbon atoms or less including a carbon atom number of substituents, such as a methyl, ethyl, propyl, butyl or phenethyl group; or a substituted or unsubstituted aryl group having 7 carbon atoms or less including a carbon atom number of substituents, such as a phenyl group. Alkyl group represented by $R_{23}$ and $R_{24}$ preferably has 8 carbon atoms or less and more preferably 5 carbon atoms or less. $R_{23}$ and $R_{24}$ each are preferably a methyl, ethyl, n-propyl, i-propyl, 2-hydroxyehtyl, 4-hydroxybutyl, 2-acetoxyethyl, 3-acetoxypropyl, 2-methoxyethyl, 4-methoxybutyl, 2-carboxyethyl, 3-carboxypropyl, 2-(2-carboxyethoxy)ethyl, 2-sulfoethyl, 3-sulfopropyl, 3-sulfobutyl, 4-sulfobutyl, 2-hydroxy-3-sulfopropyl, 2-(3-sulfopropoxy)ethyl, 2-acetoxy-3-sulfopropyl, 3-methoxy-2-(3-sulfopropoxy)propyl, 2-[2-(3-sulfopropoxy)ethoxy]ethyl, 2-hydroxy-3-(3-sulfopropoxy)-propyl, benzyl or phenethyl group.

Preferable substituents substituted on the alkyl group represented by $R_{25}$ include a phenyl group, and preferable substitutents substituted on the aryl group represented by $R_{25}$ include a halogen atom, a hydroxyl group, an alkyl group and an alkoxy group.

Preferable substituents substituted on the group represented by $R_{23}$ and $R_{24}$ include a sulfonic acid group, a carboxyl group, a hydroxyl group, an aryl group, an alkoxyl group, an acyl group and a combination thereof.

Of substituents on the nuclei in the formula, two alkyl groups may form a ring, for example, an acenaphthenothiazole ring or an acenaphthenoselenazole ring.

Specific examples of compounds of formula (I) are described below, but, the present invention is not to be construed as being limited to these examples.

| Mother Skeleton | Compound No. | X | Y | A | A′ | $R_{25}$ | $R_{23}$ | $R_{24}$ | $X_{21}$ | $n_{21}$ |
|---|---|---|---|---|---|---|---|---|---|---|
| 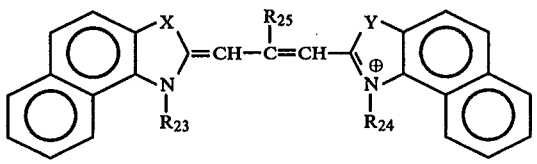 $(X_{21})_{n21}$ | I-1 | S | S | — | — | $-C_2H_5$ | $-C_2H_5$ | $-C_2H_5$ | $I^{\ominus}$ | 1 |
| | I-2 | " | " | — | — | " | " | $-(CH_2)_3SO_3^{\ominus}$ | — | 0 |
| | I-3 | " | " | — | — | " | $-(CH_2)_3SO_3^{\ominus}$ | " | $H^{\oplus}NEt_3$ | 1 |
| | I-4 | " | " | — | — | 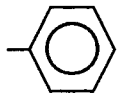 | $-C_2H_5$ | $-C_2H_5$ | $I^{\ominus}$ | 1 |
| | I-5 | " | " | — | — | " | " | $-(CH_2)_3SO_3^{\ominus}$ | — | 0 |
| | I-6 | " | " | — | — | " | $-(CH_2)_3SO_3^{\ominus}$ | " | $H^{\oplus}NEt_3$ | 1 |
| 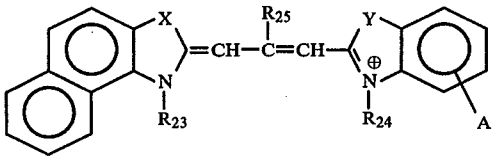 $(X_{21})_{n21}$ | I-7 | S | S | 5-Cl | — | $-C_2H_5$ | $-C_2H_5$ | $-(CH_2)_3SO_3^{\ominus}$ | — | 0 |
| | I-8 | " | " | 5-$OCH_3$ | — | " | " | " | — | 0 |
| | I-9 | " | " | 5-$OCH_3$-6-$CH_3$ | — | " | " | " | — | 0 |
| | I-10 | " | " | 5-Cl | — | 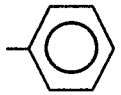 | " | " | — | 0 |
| | I-11 | " | " | 5-$OCH_3$ | — | " | " | " | — | 0 |
| | I-12 | " | " | 5-$OCH_3$-6-$CH_3$ | — | " | " | " | — | 0 |
| | I-13 | S | Se | — | — | $-C_2H_5$ | $-C_2H_5$ | $-C_2H_5$ | $I^{\ominus}$ | 1 |
| | I-14 | " | " | — | — | " | " | $-(CH_2)_3SO_3^{\ominus}$ | — | 0 |
| | I-15 | " | " | 5-Cl | — | " | " | $-C_2H_5$ | $I^{\ominus}$ | 1 |
| | I-16 | " | " | " | — | " | " | $-(CH_2)_3SO_3^{\ominus}$ | — | 0 |
| | I-17 | " | " | 5-$CH_3$ | — | " | " | $-C_2H_5$ | $I^{\ominus}$ | 1 |
| 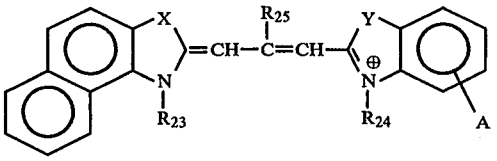 $(X_{21})_{n21}$ | I-18 | S | Se | 5-$CH_3$ | — | $-C_2H_5$ | $-C_2H_5$ | $-(CH_2)_3SO_3^{\ominus}$ | — | 0 |
| | I-19 | " | " | 5-$OCH_3$ | — | " | " | " | — | 0 |
| | I-20 | " | " | 5-OH | — | " | " | $-C_2H_5$ | $I^{\ominus}$ | 1 |
| | I-21 | " | " | " | — | " | " | $-(CH_2)_3SO_3^{\ominus}$ | — | 0 |
| | I-22 | " | " | 5,6-di$CH_3$ | — | " | " | " | — | 0 |
| | I-23 | " | " | 5-Cl | — | 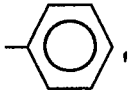 | " | " | — | 0 |
| | I-24 | " | " | 5-$OCH_3$ | — | " | " | " | — | 0 |
| | I-25 | " | " | 5-$OCH_3$-6-$CH_3$ | — | " | " | " | — | 0 |

-continued

| Mother Skeleton | Compound No. | X | Y | A | A' | $R_{25}$ | $R_{23}$ | $R_{24}$ | $X_{21}$ | $n_{21}$ |
|---|---|---|---|---|---|---|---|---|---|---|
| 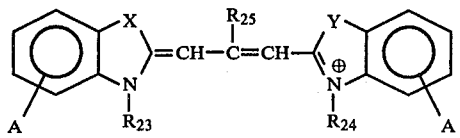 $(X_{21})_{n21}$ | I-26 | S | S | 5-Cl | — | 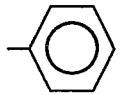 | $-(CH_2)_3SO_3^{\ominus}$ | $-(CH_2)_3SO_3^{\ominus}$ | $H^{\oplus}NEt_3$ | 1 |
| | I-27 | " | " | 5-$OCH_3$ | — | " | " | " | " | 1 |
| | I-28 | " | " | 5-$OCH_3$ | 5'-$CH_3$ | " | " | " | " | 1 |
| | I-29 | Se | Se | — | — | $-C_2H_5$ | $-C_2H_5$ | $-C_2H_5$ | $I^{\ominus}$ | 1 |
| | I-30 | " | " | 5-Cl | — | " | " | " | " | 1 |
| | I-31 | " | " | 5-$CH_3$ | — | " | " | " | " | 1 |
| | I-32 | " | " | 5-OH | — | " | " | " | " | 1 |
| | I-33 | " | " | 5-$OCH_3$ | — | " | " | " | " | 1 |
| | I-34 | " | " | 5,6-di$CH_3$ | — | " | " | " | " | 1 |
| 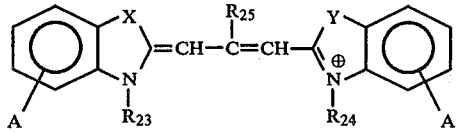 $(X_{21})_{n21}$ | I-35 | Se | Se | 5-Cl | — | $-C_2H_5$ | $-C_2H_5$ | $-(CH_2)_3SO_3^{\ominus}$ | — | 0 |
| | I-36 | " | " | " | 5'-$CH_3$ | " | " | " | — | 0 |
| | I-37 | " | " | — | — | " | $-(CH_2)_3SO_3^{\ominus}$ | " | $H^{\oplus}NEt_3$ | 1 |
| | I-38 | " | " | 5-Cl | — | " | " | " | " | 1 |
| | I-39 | " | " | 5-$CH_3$ | — | " | " | " | " | 1 |
| | I-40 | " | " | 5-OH | — | " | " | " | " | 1 |
| | I-41 | " | " | 5-$OCH_3$ | — | " | " | " | " | 1 |
| | I-42 | " | " | 5,6-di$CH_3$ | — | " | " | " | " | 1 |
| 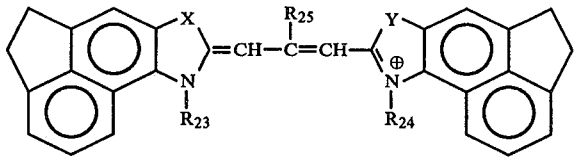 $(X_{21})_{n21}$ | I-43 | S | S | — | — | $-C_2H_5$ | $-C_2H_5$ | $-C_2H_5$ | $I^{\ominus}$ | 1 |

The color sensitizing dye of formula (I) can be incorporated into a silver halide emulsion of the photographic material of the present invention by directly dispersing the dye in the emulsion or, alternatively, it may first be dissolved in a single solvent comprising water, methanol, ethanol, propanol, methyl cellosolve or 2,2,3,3-tetrafluoropropanol or a mixed solvent comprising two or more of them to form a dye solution and the resulting dye solution may be added to the emulsion. In addition, the dye may be dissolved in an aqueous solution along with an acid or base in accordance with the techniques as described in JP-B-44-23389, 44-27555 and 57-22089 (the term "JP-B" as used herein means an "examined Japanese patent publication"); or it may be formed into an aqueous solution or a colloidal dispersion in the presence of a surfactant in accordance with the technique as described in U.S. Pat. No. 4,006,025; and the resulting aqueous solution or colloidal dispersion may be added to the emulsion. The dye may also be dissolved in a substantially water-immiscible solvent, such as phenoxyethanol, then dispersed in water or a hydrophilic colloid, and the resulting dispersion may be added to the emulsion. The dye may directly be dispersed in a hydrophilic colloid and the resulting dispersion may be added to the emulsion, in accordance with the procedure described in JP-A-53-102733 and 58-105141.

The time of adding the dye of formula (I) to the emulsion is not specifically limited and the dye may be added thereto at any stage of forming the emulsion or may be added thereto just before coating. For instance, the dye may be added to the emulsion at the same time a chemical sensitizer is added to simultaneously achieve color sensitization and chemical sensitization of the emulsion, in accordance with the technique described in U.S. Pat. No. 4,225,666; or it may be added to the emulsion prior to chemical sensitization, in accordance with the technique described in JP-A-58-113928; or it may be added to the emulsion before completion of formation of the silver halide grains to achieve color sensitization of the grains. Portionwise addition of the color sensitizing dye of formula (I) may also be possible in accordance with the manner described in U.S. Pat. No. 4,225,666. For instance, some of the dye is first added to the emulsion prior to chemical sensitization thereof and the remainder is then added thereto after chemical sensitization of the emulsion. Moreover, the dye may be added during formation of silver halide grains of the emulsion, for example, in accordance with the method illustrated in U.S. Pat. No. 4,183,756.

The amount of the color sensitizing dye of formula (I) present in the emulsion of the photographic material of the present invention is preferably from $5\times10^{-6}$ to $5\times10^{-3}$ mol, more preferably from $2\times10^{-5}$ to $1\times10^{-3}$ mol, per mol of silver halide in the emulsion.

The halogen composition of the silver halide emulsion grains of the photographic material of the present invention are grains of silver chlorobromide where 95 mol % or more of the total grains are silver chloride grains, or pure silver chloride grains, and silver chlorobromide and silver chloride grains are substantially free from silver iodide. Silver chlorobromide or silver chloride grains which are substantially free from silver iodide mean that the grains have a silver iodide content of 1.0 mol % or less. Preferably, the silver halide grains of the high silver halide emulsion of the present invention are silver chlorobromide grains having a silver chloride content of 98 mol % or more of the total silver halide composing silver halide grains or are silver chloride grains, which contain substantially no silver iodide. Most preferably, the silver halide grains of the high silver halide emulsion of the present invention are silver chlorobromide grains having a silver chloride content of 99 mol % or more of the total silver halide composing silver halide grains or are silver chloride grains, which contain substantially no silver iodide.

The silver halide emulsion grains of the photographic material of the present invention preferably have a silver bromide localized phase in an amount of more than 10 mol % as silver bromide. The position of such a high silver bromide localized phase in the grains is preferably near the surface of the grains for the purpose of effectively displaying the effect of the present invention and in view of the pressure resistance of the material achieved and the composition dependence of the processing solution used in processing the material. The position near the surface of the silver halide grain means a depth of 1/5 or less of the grain thickness from the outermost surface of the grain. More preferably, the high silver bromide localized phase is at a depth of 1/10 or less of the grain size from the outermost surface of the grain. As the most preferred example of the position of the high silver bromide localized phase, a silver bromide localized phase having a silver bromide content of more than 10 mol % is on the corners of cubic or tetradecahedral silver chloride grains formed by epitaxial growth.

The silver bromide content in the high silver bromide localized phase must be more than 10 mol %, but if the silver bromide content is too high in this phase, the phase often causes desensitization of the photographic material when a pressure is imparted to the material or the sensitivity and gradation of the material greatly vary because of changes in the composition of the processing solution used in processing the material. Such a silver bromide localized phase with too high a silver bromide content often results in unfavorable properties in the photographic material. In view of these points, the silver bromide content in the high silver bromide localized phase is preferably from 10 to 60 mol %, most preferably from 20 to 50 mol %. The silver bromide content of the high silver bromide localized phase may be analyzed by an X-ray diffraction method (for example, as described in *Lectures of New Experimental Chemistry*, No. 6, Structure Analyses, edited by Nippon Chemical Society and published by Maruzen Publishing Co., Japan). Preferably, the high silver bromide localized phase has a silver content of from 0.1 to 20%, more preferably from 0.5 to 10%, of the total silver content of the silver halide grains with the localized phase.

The interface between the high silver bromide localized phase and the other phase in the silver halide grain of the photographic material of the present invention may have a distinct phase boundary or, alternatively, may have a region where the halogen composition gradually varies therebetween.

Various methods may be employed for forming such a high silver bromide localized phase. For instance, a soluble silver salt and soluble halides can be reacted in a single jet method or a double jet method to form the desired localized phase. In addition, a halogen conversion method in which already formed silver halide grains are converted into those having a lower solubility product may also be employed for forming the intended localized phase. More preferably, for conveniently achieving the effect of the present invention, the high silver bromide localized phase is formed in such a way that cubic or tetradecahedral host silver halide grains are blended and ripened with fine silver halide grains having a smaller mean grain size than the host grains and having a higher silver bromide content than the host grains to thereby form a high silver bromide phase on the silver halide host grains.

The silver halide emulsions of the photographic material of the present invention are preferably chemically sensitized. For chemical sensitization of the emulsions, for example, sulfur sensitization, selenium sensitization, reduction sensitization or gold sensitization may be employed. Sulfur sensitization is especially preferred.

Sulfur-containing compounds capable of reacting with an active gelatin or silver, such as thiosulfates, thioureas, mercapto compounds and rhodanines can be used for chemically sensitizing the silver halide emulsions of the present invention with sulfur. Specific examples of suitable sulfur-containing compounds are described in U.S. Pat. Nos. 1,574,944, 2,278,947, 2,410,689, 2,728,668 and 3,656,955.

The silver halide grains of the photographic material of the present invention may be those having a (100) plane as the outer surface or those having a (111) plane as the outer surface or those having both planes as the outer surface. In addition, they may also be those having a higher order plane. Preferably, the grains are cubic or tetradecahedral grains essentially having a (100) plane.

The size of the silver halide grains of the photographic material of the present invention may vary over a wide range. Preferably, the grains have a mean grain size of from 0.1 μm to 1.5 μm. The grain size distribution of the grains may be either polydispersed or monodispersed. Preferably, the grains are monodispersed grains. The grain size distribution of the grains indicating the degree of the monodispersibility of the grains is such that the ratio (s/d) of the statistical standard deviation (s) to the mean grain size (d) is 0.2 or less, more preferably 0.15 or less. It is also preferred to use a mixture comprising two or more kinds of monodispersed emulsions.

The silver halide emulsion grains of the photographic material of the present invention preferably contain an iridium compound. Examples of usable iridium compounds are hexachloroiridates(III) or (IV), hexamineiridates(III) or (IV) and trioxalatoiridates(III) or (IV).

In particular, it is preferred to incorporate an iridium compound in the high silver bromide localized phase, or to form the localized phase in the presence of an iridium compound. Formation of the localized phase in the presence of an iridium compound may be effected by adding an iridium compound to the silver halide emulsion simultaneously with, or just before, or just after addition of silver or halogen for forming the localized phase to the emulsion. Where the high silver bromide localized phase is formed by blending host silver halide grains and other fine silver halide grains having a smaller mean grain size and a higher silver bromide content than the host grains followed by ripening the resulting blend, it is preferred to previously incorporate an iridium compound into the fine silver halide grains having a higher silver bromide content.

The amount of the iridium compound to be employed in the above-described case is preferably from $10^{-9}$ mol to $10^{-6}$ mol, most preferably from $10^{-8}$ mol to $10^{-6}$ mol, per mol of silver halide in the emulsion.

To improve the sharpness of the image formed on the photographic material of the present invention, it is preferred to incorporate a dye capable of being decolored by the photographic processing, as described in European Patent 0,337,490A2 (especially oxonole dyes), into the hydrophilic colloid layer of the material in such an amount that the optical reflection density of the material at 680 nm is 0.70 or more, or to incorporate titanium oxide surface-treated with a di-hydric to tetrahydric alcohol (e.g., trimethylolethane) into the waterproof resin layer of the support of the material in an amount of 12% by weight or more, more preferably 14% by weight or more.

The photographic material of the present invention preferably contains a color image preservability improving compound, for example, a compound as described in European Patent 0,277,589A2, along with couplers.

Incorporation of such a color image preservability improving compound into the material along with a pyrazoloazole coupler is preferred.

Specifically, the single or combined incorporation of a compound (F) capable of chemically binding with the aromatic amine developing agent remaining in the photographic material after color development thereof to form a chemically inert and substantially colorless compound and/or a compound (G) capable of chemically binding with the oxidation product of an aromatic amine developing agent remaining in the photographic material after color development thereof to form a chemically inert and substantially colorless compound into the photographic material of the present invention is preferred for the purpose of preventing formation of color dyes by reaction of the color developing agent or the oxidation product thereof remaining in the photographic material and couplers in the material during storage of the processed material which results in the formation of stains in the processed material during storage thereof and also preventing any other harmful side effect of the remaining developing agent and the oxidation product thereof.

The photographic material of the present invention also preferably contains a microbiocide, such as the one as described in JP-A-63-271247, for the purpose of preventing propagation of various fungi and bacteria in the hydrophilic colloid layer of the processed material which would deteriorate the image formed on the material.

Suitable supports of the photographic material of the present invention include a white polyester support or a support having a white pigment-containing layer on the side on which the silver halide emulsion layers are coated may be employed. In order to improve the sharpness of the image to be formed, it is preferred to provide an anti-halation layer on the support on either of the side on which the silver halide emulsion layers are coated or the opposite side thereto. In particular, it is preferred for the transmission density of the support to be within the range of from 0.35 to 0.8, in order that the the photographic material of the present invention be may seen either with reflected light or transmitted light.

The photographic material of the present invention may be exposed either with visible light or with infrared light. For exposure of the material, either low intensity exposure or high intensity short-time exposure may be employed. In particular, in the latter case, a laser scanning exposure system is preferred where the exposure time is shorter than $10^{-4}$ second per pixel.

A band stop filter described in U.S. Pat. No. 4,880,726 is preferably used for exposure of the photographic material of the present invention. Using such a filter allows rays causing color mixture to be removed so that the color reproducibility of the exposed material is improved noticeably.

The exposed photographic material is color-developed and then preferably bleach-fixed for the purpose of effecting rapid processing. In particular, when the high silver chloride emulsion(s) disclosed above is used, the pH of the bleach-fixing solution is preferably about 6.5 or less, especially preferably about 6 or less, for the purpose of promoting desilvering of the material.

The silver halide emulsions and other elements (e.g., additives, etc.) of the photographic material of the present invention, the photographic layers of the material (e.g., arrangement of layers), and methods of processing the material and additives usable in the processing methods are described in the following patent publications, especially in European Patent 0,355,660A2 (corresponding to Japanese Patent Application No. 1-107011) and are preferably employed.

| Photographic Elements | JP-A-62-215272 | JP-A-2-33144 | EP 0,355,660A2 |
|---|---|---|---|
| Silver Halide Emulsions | From page 10, right upper column, line 6 to page 12, left lower column, line 5; and from page 12, right lower column, line 4 to page 13, left upper column, line 17 | From page 28, right upper column, line 16 to page 29, right lower column, line 11; and page 30, lines 2 to 5 | From page 45, line 53 to page 47, line 3; and page 47, lines 20 to 22 |
| Silver Halide Solvents | Page 12, left lower column, lines 6 to 14; and from page 13, left upper column, line 3 from below to page 18, left lower column, last line | — | — |
| Chemical Sensitizers | Page 12, from left lower column, line 3 from below to right lower column, line 5 from below; and from page 18, right lower column, line 1 to page 22, right upper column, line 9 from below | Page 29, right lower column, line 12 to last line | Page 47, lines 4 to 9 |
| Spectral Sensitizers (Spectral Sensitizing Methods) | From page 22, right upper column, line 8 from below to page 38, last line | Page 30, left upper column, lines 1 to 13 | Page 47, lines 10 to 15 |
| Emulsion Stabilizers | From page 39, left upper column, line 1 to page 72, right upper column, last line | Page 30, from left upper column, line 14 to right upper column, line 1 | Page 47, lines 16 to 19 |
| Development Promoters | From page 72, left lower column, line 1 to page 91, right upper column, line 3 | — | — |
| Color Couplers (Cyan, Magenta and Yellow Couplers) | From page 91, right upper column, line 4 to page 121, left upper column, line 6 | From page 3, right upper column, line 14 to page 18, left upper column, last line; and from page 30, right upper column, line 6 to page 35, right lower column, line 11 | Page 4, lines 15 to 27; from page 5, line 30 to page 8, last line; page 45, lines 29 to 31; and from page 47, line 23 to page 63, line 50 |
| Coloring Enhancers | From page 121, left upper column, line 7 to page 125, right upper column, line 1 | — | — |
| Ultraviolet Absorbents | From page 125, right upper column, line 2 to page 127, left lower column, last line | From page 37, right lower column, line 14 to page 38, left upper column, line 11 | Page 65, lines 22 to 31 |
| Anti-fading Agents (Color Image Stabilizers) | From page 127, right lower column, line 1 to page 137, left lower column, line 8 | From page 36, right upper column, line 12 to page 37, left upper column, line 19 | From page 4, line 30 to page 5, line 23; from page 29, line 1 to page 45, line 25; page 45, lines 33 to 40; and page 65, lines 2 to 21 |
| High Boiling Point and/or Low Boiling Point Organic Solvents | From page 137, left lower column, line 9 to page 144, right upper column, last line | From page 35, right lower column, line 14 to page 36, left upper column, line 4 from below | Page 64, lines 1 to 51 |
| Dispersing Methods of Photographic Additives | From page 144, left lower column, line 1 to page 146, right upper column, line 7 | From page 27, right lower column, line 10 to page 28, left upper column, last line; and from page 35, right lower column, line 12, to page 36, right upper column, line 7 | From page 63, line 51 to page 64, line 56 |
| Hardening Agents | From page 146, right upper column, line 8 to page 155, left lower column, line 4 | — | — |
| Developing Agent Precursors | Page 155, from left lower column, line 5 to right lower column, line 2 | — | — |
| Development Inhibitor | Page 155, right lower | — | — |

-continued

| Photographic Elements | JP-A-62-215272 | JP-A-2-33144 | EP 0,355,660A2 |
|---|---|---|---|
| Releasing Compounds | column, lines 3 to 9 | | |
| Supports | From page 155, right lower column, line 19 to page 156, left upper column, line 14 | From page 38, right upper column, line 18 to page 39, left upper column, line 3 | From page 66, line 29 to page 67, line 13 |
| Constitution of Photographic Layers | Page 156, from left upper column, line 15 to right lower column, line 14 | Page 28, right upper column, lines 1 to 15 | Page 45, lines 41 to 52 |
| Dyes | From page 156, right lower column, line 15 to page 184, right lower column, last line | Page 38, from left upper column, line 12 to right upper column, line 7 | Page 66, lines 18 to 22 |
| Color Mixing Preventing Agents | From page 185, left upper column, line 1 to page 188, right lower column, line 3 | Page 36, right lower column, lines 8 to 11 | From page 64, line 57 to page 65, line 1 |
| Gradation Adjusting Agents | Page 188, right lower column, lines 4 to 8 | — | — |
| Stain Inhibitors | From page 188, right lower column, line 9 to page 193, right lower column, line 10 | Page 37, from left upper column, last line to right lower column, line 13 | From page 65, line 32 to page 66, line 17 |
| Surfactants | From page 201, left lower column, line 1 to page 210, right upper column, last one | From page 18, right upper column, line 1 to page 24, right lower column, last line; and page 27, from left lower column, line 10 from below to right lower column, line 9 | — |
| Fluorine-containing Compounds (as antistatic agents, coating aids, lubricants, and anti-blocking agents) | From page 210, left lower column, line 1 to page 222, left lower column, line 5 | From page 25, left upper column, line 1 to page 27, right lower column, line 9 | — |
| Binders (hydrophilic colloids) | From page 222, left lower column, line 6 to page 225, left upper column, last line | Page 38, right upper column, lines 8 to 18 | Page 66, lines 23 to 28 |
| Tackifiers | From page 225, right upper column, line 1 to page 227, right upper column, line 2 | — | — |
| Antistatic Agents | From page 227, right upper column, line 3 to page 230, left upper column, line 1 | — | — |
| Polymer Latexes | From page 230, left upper column, line 2 to page 239, last line | — | — |
| Mat Agents | Page 240, from left upper column, line 1 to right upper column, last line | — | — |
| Photographic Processing Methods (Processing steps and additives) | From page 3, right upper column, line 7 to page 10, right upper column, line 5 | From page 39, left upper column, line 4 to page 42, left upper column, last line | From page 67, line 14 to page 69, line 28 |

Notes:
The specification of JP-A-62-215272 cited above is as amended by amendment filed on March 16, 1987.

The so-called short-wave type yellow couplers as described in JP-A-63-231451, 63-123047, 63-241547, 1-173499, 1-213648 and 1-250944 are also preferably employed as yellow couplers, in addition to those described above.

3-Hydroxypyridine cyan couplers as described in European Patent 0,333,185A2 (Especially, 2-equivalent couplers by adding a chlorinated releasable group to the illustrated 4-equivalent Coupler (42), as well as the illustrated Couplers (6) and (9) are preferred.), and the cyclic active methylene cyan couplers as described in JP-A-64-32260 (Especially, Couplers Nos. 3, 8 and 34 specifically illustrated therein are preferred.) are also preferably employed as cyan couplers, in addition to diphenylimidazole cyan couplers described in the above-mentioned JP-A-2-33144.

In accordance with the present invention, the color developer to be used in processing the photographic material needs to contain chloride ion in an amount of from $3.5\times10^{-2}$ to $1.5\times10^{-1}$ mol/liter, preferably from $4\times10^{-2}$ to $1\times10^{-1}$ mol/liter. If the chloride ion concentration in the color developer is more than $1.5\times10^{-1}$ mol/liter, development of the material therewith is delayed or retarded so that the maximum density of the image formed is disadvantageously low. On the contrary, however, if the chloride ion concentration is less than $3.5\times10^{-2}$ mol/liter, fluctuation of the photographic properties of the processed material, especially fluctuation in the minimum density of the formed image, in continuous processing is disadvantageously large.

In addition, in accordance with the present invention, the color developer also needs to contain bromide ion in an amount of from $1.5\times10^{-5}$ to $1.0\times10^{-3}$ mol/liter, preferably from $2\times10^{-5}$ to $5\times10^{-4}$ mol/liter. If the bromide ion concentration in the developer is more than $1.0\times10^{-3}$ mol/liter, development of the material therewith is delayed or retarded so that the maximum density of the formed image and sensitivity are disadvantageously low. On the contrary, however, if the bromide ion concentration is less than $1.5\times10^{-5}$ mol/liter, fluctuation of the photographic properties of the processed material, especially fluctuation in the minimum density of the formed image, in continuous processing is not effectively prevented.

The chloride ion and bromide ion may be directly added to the color developer, or they may be dissolved from the photographic material being processed with the color developer.

In the former case where the ions are directly added to the color developer, a chloride ion-donating material is added thereto, which includes, for example, sodium chloride, potassium chloride, ammonium chloride, nickel chloride, magnesium chloride, manganese chloride, calcium chloride and cadmium chloride. Of them, sodium chloride and potassium chloride are preferred.

The ions may also be added to the developer in the form of a salt of a brightening agent to be added thereto. Examples of bromide ion-donating materials usable in the present invention are mentioned sodium bromide, potassium bromide, ammonium bromide, lithium bromide, calcium bromide, magnesium bromide, manganese bromide, nickel bromide, cadmium bromide, cerium bromide and thallium bromide. Of them, preferred are potassium bromide and sodium bromide.

In the latter case where the ions are dissolved out into the color developer from the photographic material being processed therein, both the chloride ion and the bromide ion may be derived from the silver halides in the emulsions in the material or may also be derived from any other layers in the material.

The present invention is explained in more detail by way of the following examples, which, however, are not intended to restrict the scope of the present invention. Unless otherwise indicated herein, all parts, percents, ratios and the like are by weight.

EXAMPLE 1

32 g of a lime-processed gelatin was added to 1000 cc of distilled water and dissolved at 40° C., 3.3 g of sodium chloride was added thereto, and the temperature of the resulting solution was increased to 60° C. To the solution was added 1.8 cc of an aqueous 1% solution of N,N'-dimethylimidazolidine-2-thione. Next, a solution of 32.0 g of silver nitrate dissolved in 200 cc of distilled water and a solution of 11.0 g of sodium chloride dissolved in 200 cc of distilled water were added, with stirring, to the previously prepared solution over a period of 14 minutes at 60° C. Further, a solution of 128.0 g of silver nitrate dissolved in 560 cc of distilled water and a solution of 44.0 g of sodium chloride dissolved in 560 cc of distilled water were added thereto, with stirring, over a period of 40 minutes at 60° C. The resulting emulsion was desalted and washed with water at 40° C., 90.0 g of a lime-processed gelatin was added thereto, and sodium chloride and sodium hydroxide were added thereto whereby the pAg and pH of the emulsion were adjusted to be 7.5 and 6.5, respectively. Subsequently, the emulsion was optimally sulfur-sensitized with triethylthiourea at 50° C. The silver chloride emulsion thus obtained was designated Emulsion (A).

32 g of a lime-processed gelatin was added to 1000 cc of distilled water and dissolved at 40° C., 3.3 g of sodium chloride was added thereto, and the temperature of the resulting solution was increased to 60° C. To the solution was added 2.0 cc of an aqueous 1% solution of N,N'-dimethylimidazolidine-2-thione. Next, a solution of 32.0 g of silver nitrate dissolved in 200 cc of distilled water and a solution of 10.9 g of sodium chloride and 0.22 g of potassium bromide dissolved in 200 cc of distilled water were added, with stirring, to the previously prepared solution over a period of 15 minutes at 60° C. Further, a solution of 128.0 g of silver nitrate dissolved in 560 cc of distilled water and a solution of 43.6 g of sodium chloride and 0.90 g of potassium bromide dissolved in 560 cc of distilled water were added thereto, with blending, over a period of 40 minutes at 60° C. The resulting emulsion was desalted and washed with water at 40° C., 90.0 g of a lime-processed gelatin was added thereto, and sodium chloride and sodium hydroxide were added thereto whereby the pAg and pH of the emulsion were adjusted to 7.5 and 6.5, respectively. Subsequently, the emulsion was optimally sulfur-sensitized with triethylthiourea at 50° C. The silver chlorobromide emulsion (having a silver bromide content of 1 mol %) thus obtained was designated Emulsion (B).

32 g of a lime-processed gelatin was added to 1000 cc of distilled water and dissolved at 40° C., 3.3 g of sodium chloride was added thereto, and the temperature of the resulting solution was increased to 60° C. To the solution was added 2.4 cc of an aqueous 1% solution of N,N'-dimethylimidazolidine-2-thione. Next, a solution of 32.0 g of silver nitrate dissolved in 200 cc of distilled water and a solution of 10.2 g of sodium chloride and 1.57 g of potassium bromide dissolved in 200 cc of distilled water were added, with stirring, to the previously prepared solution over a period of 20 minutes at 60° C. Further, a solution of 128.0 g of silver nitrate dissolved in 560 cc of distilled water and a solution of 41.0 g of sodium chloride and 6.28 g of potassium bromide dissolved in 560 cc of distilled water were added thereto, with stirring, over a period of 60 minutes at 60° C. The resulting emulsion was desalted and washed with water at 40° C., 90.0 g of a lime-processed gelatin was added thereto, and sodium chloride and sodium hydroxide were added thereto whereby the pAg and pH of the emulsion were adjusted to 7.5 and 6.5, respectively. Subsequently, the emulsion was optimally sulfur-sensitized with triethylthiourea at 50° C. The silver chlorobromide emulsion (having a silver bromide content of 7 mol %) thus obtained was designated Emulsion (C).

Still another silver chlorobromide emulsion was prepared in the same manner as in preparation of Emulsion (A), except that an emulsion of ultra-fine silver bromide grains (having a grain size of 0.05 μm) was added to the intermediate emulsion, prior to sulfur-sensitization thereof, in an amount of 1.0 mol %, with respect to the silver chloride present, of silver bromide, then the resulting emulsion blend was ripened for 15 minutes at 50° C. and thereafter subjected to optimal sensitization. The thus prepared silver chlorobromide emulsion was Emulsion (D).

The grain shape, grain size and grain size distribution of each of the four Emulsions (A) through (D) thus prepared were determined using their electromicrophotographs. The grain size was represented by the mean value of the diameter of a circle equivalent to the projected area of each grain; and the grain size distribution was represented by the value obtained by dividing the standard deviation of the grain size by the mean grain size. All four kinds of Emulsions (A) through (D) contained cubic grains having a mean grain size of 0.54 μm and a grain size distribution of 0.09.

Comparing the electromicrophotograph of Emulsion (D) to which ultra-fine silver bromide grains had been added and that of Emulsion (A) to which no ultra-fine silver bromide grains had been added, the corners of the cubic grains of the Emulsion (D) were found to be sharper than those of Emulsion (A). X-ray diffraction analysis of Emulsion (D) showed a weak diffraction in the part corresponding to a silver bromide content of from 10 mol % to 40 mol %. From the facts, Emulsion (D) was determined to contain cubic silver chlorobromide grains having a silver bromide localized phase with a silver bromide content of from 10 mol % to 40 mol % on the corners of the cubic silver chloride grain (host grain), the localized phase having grown by epitaxial growth.

One surface of a paper support, both surfaces of which had been laminated with polyethylene, was corona-discharged, a gelatin subbing layer containing sodium dodecylbenzenesulfonate was formed on the support, and plural photographic layers described below were formed thereon. Accordingly, a multi-layer color photographic paper (Sample No. 1) having the layer constitution described below was prepared.

Preparation of Coating Composition for First Layer 27.2 cc of ethyl acetate, 4.1 g of solvent (Solv-3) and 4.1 g of solvent (Solv-7) were added to 19.1 g of yellow coupler (ExY), 4.1 g of color image stabilizer (Cpd-1) and 0.7 g of color image stabilizer (Cpd-7), and dissolved. The resulting solution was added to 185 cc of an aqueous 10% gelatin solution containing 8 cc of sodium dodecylbenzenesulfonate and emulsified and dispersed using an ultrasonic homogenizer. The resulting dispersion was blended with a silver chlorobromide emulsion (containing silver halide cubic grains having a mean grain size of 0.80 μm and a silver bromide content of 0.5 mol % as a silver bromide localized phase partially on the surface of the grain, and containing blue-sensitizing dyes (A) and (B) each in an amount of $2\times10^{-4}$ mol per mol of silver halide), to prepare a coating composition for the First Layer.

50.0 cc of ethyl acetate and 14.0 g of solvent (Solv-6) were added to 32.0 g of cyan coupler (ExC), 3.0 g of color image stabilizer (Cpd-2), 2.0 g of color image stabilizer (Cpd-4), 18.0 g of color image stabilizer (Cpd-6), 40.0 g of color image stabilizer (Cpd-7) and 5.0 g of color image stabilizer (Cpd-8), and dissolved. The resulting solution was added to 500 cc of an aqueous 20% gelatin solution containing 8 cc of sodium dodecylbenzenesulfonate and emulsified and dispersed using an ultrasonic homogenizer. The resulting dispersion was blended with Emulsion (A) (silver chloride emulsion) to prepare a coating composition for the Fifth Layer.

Other coating compositions for the Second to Fourth Layers, Sixth Layer and Seventh Layer were prepared in the same manner as in preparation of the coating composition for the Fifth Layer mentioned above. 1-Hydroxy-3,5-dichloro-s-triazine sodium salt was added to each layer as a gelatin hardening agent for each layer.

Additionally, Cpd-10 and Cpd-11 below were added to each layer, the total amount of additive Cpd-10 being 25.0 mg/m$^2$ and that of additive Cpd-11 being 50.0 mg/m$^2$.

The following color sensitizing dyes were added to each layer.

Sensitizing Dye (A) to Blue-Sensitive Emulsion Layer

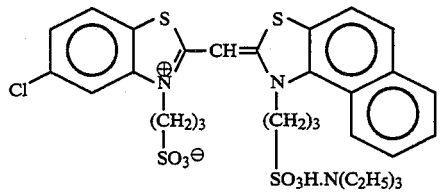

Sensitizing Dye (B) to Blue-Sensitive Emulsion Layer

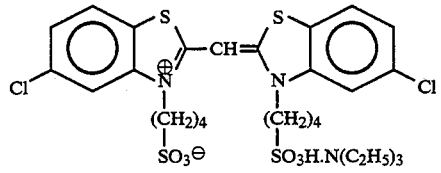

Sensitizing Dye (C) to Green-Sensitive Emulsion Layer

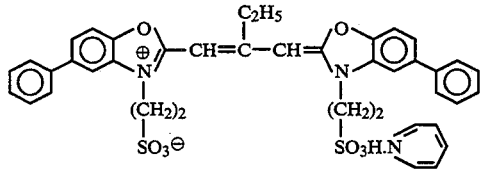

($4.0\times10^{-4}$ mol per mol of silver halide to large grain size emulsion; $5.6\times10^{-4}$ mol per mol of silver halide to small grain size emulsion)

Sensitizing Dye (D) to Green-Sensitive Emulsion Layer

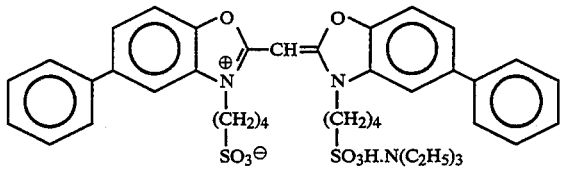

($7.0\times10^{-5}$ mol per mol of silver halide to large grain size emulsion; and $1.0\times10^{-5}$ mol per mol of silver halide to small grain size emulsion)

Sensitizing Dye (S-1) to Red-Sensitive Emulsion Layer

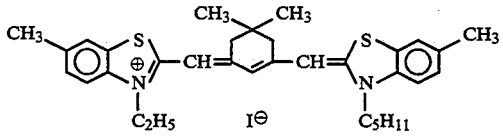

($8.0\times10^{-5}$ mol per mol of silver halide)

To the red-sensitive emulsion layer was added the following compound in an amount of $2.6\times10^{-3}$ mol per mol of silver halide.

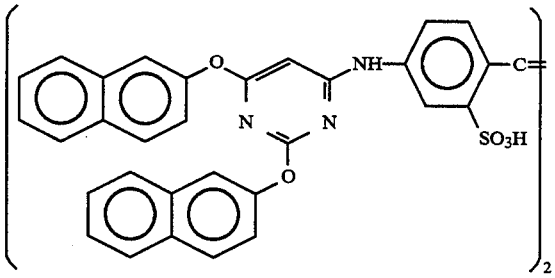

razole in an amount of $8.5\times10^{-5}$ mol, $7.7\times10^{-4}$ mol and $2.5\times10^{-4}$ mol, respectively, per mol of silver halide.

To the blue-sensitive emulsion layer and the green-sensitive emulsion layer was added 4-hydroxy-6-methyl-1,3,3a,7-tetrazaindene in an amount of $1\times10^{-4}$ mol and $2\times10^{-4}$ mol, respectively, per mol of silver halide.

The following dyes were added to the emulsion layers for anti-irradiation, each in the amount as shown in the parentheses.

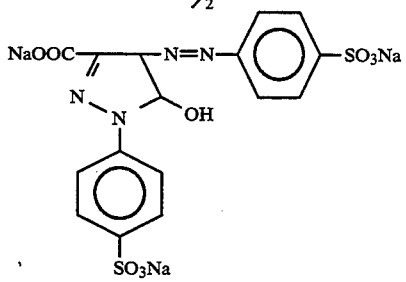

(10 mg/m²)

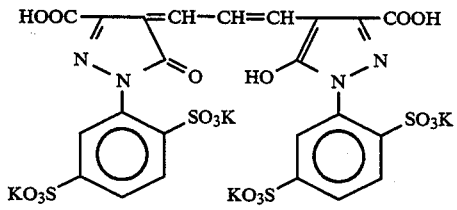

(10 mg/m²)

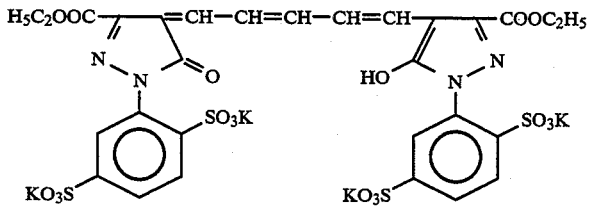

(40 mg/m²)

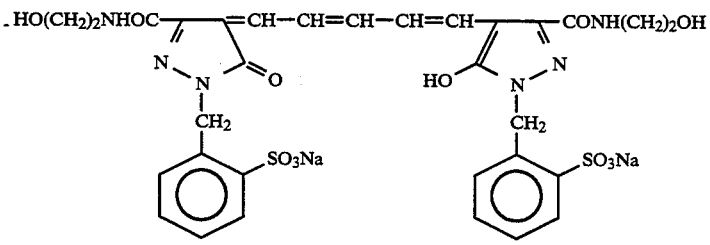

(20 mg/m²)

To the blue-sensitive emulsion layer, the green-sensitive emulsion layer and the red-sensitive emulsion layer was added 1-(5-methylureidophenyl)-5-mercapto-tet- Constitution of Layers The compositions of the layers are shown below. The number indicates the amount coated in units of g/m². The amount of silver halide emulsion coated is represented by the amount of silver therein.

| | |
|---|---|
| Support: | |
| Polyethylene-Laminated Paper (containing white pigment ($TiO_2$) and bluish dye (ultramarine) in the polyethylene below the First Layer) | |
| First Layer (Blue-sensitive Emulsion Layer): | |
| Above-mentioned Silver Bromochloride Emulsion | 0.30 |
| Gelatin | 1.86 |
| Yellow Coupler (ExY) | 0.82 |
| Color Image Stabilizer (Cpd-1) | 0.19 |
| Solvent (Solv-3) | 0.18 |
| Solvent (Solv-7) | 0.18 |

-continued

| | |
|---|---|
| Color Image Stabilizer (Cpd-7) | 0.06 |
| Second Layer (Color Mixing Preventing Layer): | |
| Gelatin | 0.99 |
| Color Mixing Preventing Agent (Cpd-5) | 0.08 |
| Solvent (Solv-1) | 0.16 |
| Solvent (Solv-4) | 0.08 |
| Third Layer (Green-sensitive Emulsion Layer): | |
| Silver Chlorobromide Emulsion (1/3 (by mol as Ag) mixture of large grain size emulsion of large-size cubic grains with mean grain size of 0.55 micron and coefficient of variation of grain size distribution of 0.10 and small grain size emulsion of small-size cubic grains with mean grain size of 0.39 micron and coefficient of variation of grain size distribution of 0.08; both large-size and small-size grains locally had 0.8 mol % of AgBr on a part of the surface of the grain) | 0.12 |
| Gelatin | 1.24 |
| Magenta Coupler (ExM) | 0.23 |
| Color Image Stabilizer (Cpd-2) | 0.03 |
| Color Image Stabilizer (Cpd-3) | 0.16 |
| Color Image Stabilizer (Cpd-4) | 0.02 |
| Color Image Stabilizer (Cpd-9) | 0.02 |
| Solvent (Solv-2) | 0.40 |
| Fourth Layer (Ultraviolet Absorbing Layer): | |
| Gelatin | 1.58 |
| Ultraviolet Absorbent (UV-1) | 0.47 |
| Color Mixing Preventing Agent (Cpd-5) | 0.05 |
| Solvent (Solv-5) | 0.24 |
| Fifth Layer (Red-sensitive Emulsion Layer): | |
| Silver Chloride Emulsion (A) | 0.23 |
| Gelatin | 1.34 |
| Cyan Coupler (ExC) | 0.32 |
| Color Image Stabilizer (Cpd-2) | 0.03 |
| Color Image Stabilizer (Cpd-4) | 0.02 |
| Color Image Stabilizer (Cpd-6) | 0.18 |
| Color Image Stabilizer (Cpd-7) | 0.40 |
| Color Image Stabilizer (Cpd-8) | 0.05 |
| Solvent (Solv-6) | 0.14 |
| Sixth Layer (Ultraviolet Absorbing Layer): | |
| Gelatin | 0.53 |
| Ultraviolet Absorbent (UV-1) | 0.16 |
| Color Mixing Preventing Agent (Cpd-5) | 0.02 |
| Solvent (Solv-5) | 0.08 |
| Seventh Layer (Protective Layer): | |
| Gelatin | 1.33 |
| Acryl-modified Copolymer of Polyvinyl Alcohol (modification degree 17%) | 0.17 |
| Liquid Paraffin Compounds used above are as follows: | 0.03 |

(ExY) Yellow Coupler:

1/1 (by mol) mixture of the following compounds:

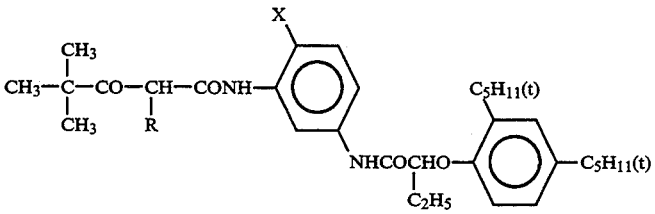

R = 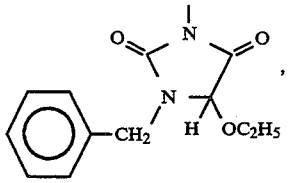 , X = Cl and

R = 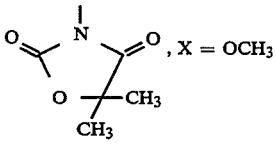 , X = $OCH_3$ (ExM) Magenta Coupler:

-continued
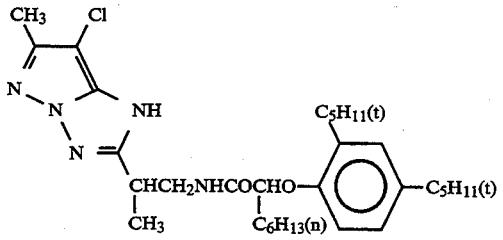
(ExC) Cyan Coupler:
1/1 (by mol) mixture of the following compounds:
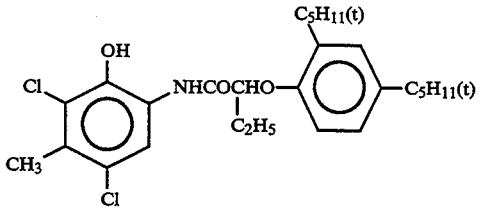
and
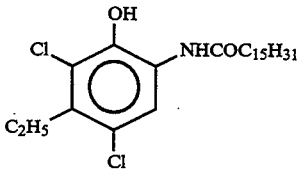
(Cpd-1) Color Image Stabilizer:
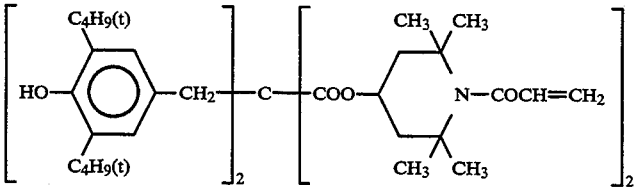
(Cpd-2) Color Image Stabilizer:
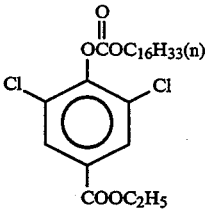
(Cpd-3) Color Image Stabilizer:
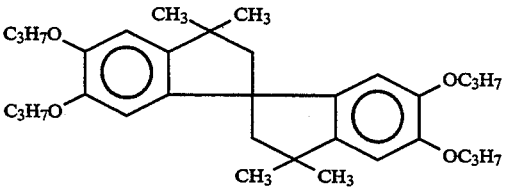
(Cpd-4) Color Image Stabilizer:

-continued
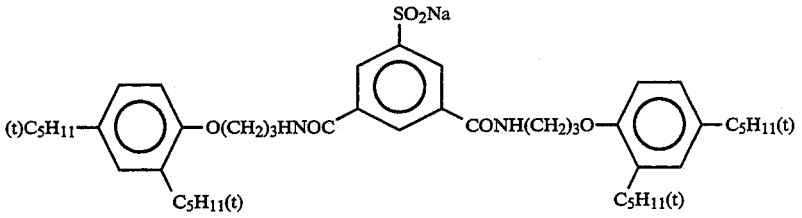
(Cpd-5) Color Mixing Preventing Agent:
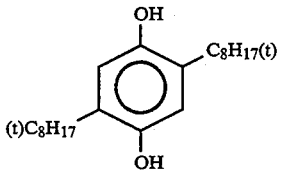
(Cpd-6) Color Image Stabilizer:
2/4/4 (by weight) mixture of the following compounds:
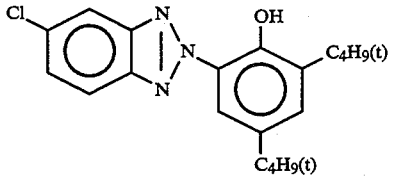
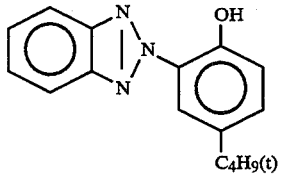
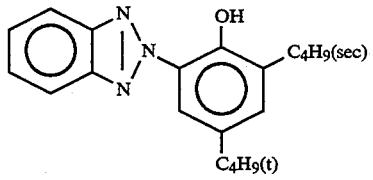
(Cpd-7) Color Image Stabilizer:
$$\left(CH_2-\underset{\underset{CONHC_4H_9(t)}{|}}{CH}\right)_n$$
(mean molecular weight 60,000)
(Cpd-8) Color Image Stabilizer:
1/1 (by weight) mixture of the following compounds:
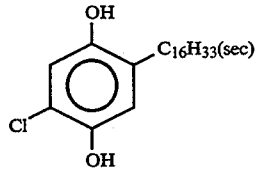
and
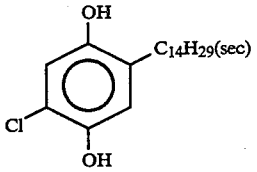
(Cpd-9) Color Image Stabilizer:

-continued
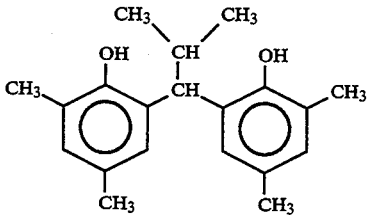
(Cpd-10) Antiseptic:
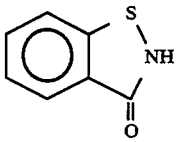
(Cpd-11) Antiseptic:
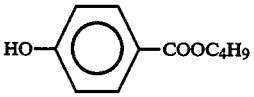
(UV-1) Ultraviolet Absorbent:
4/2/4 (by weight) mixture of the following compounds:
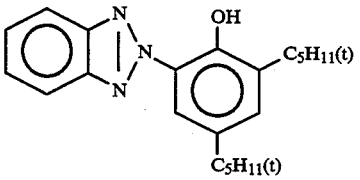
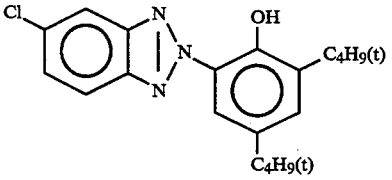
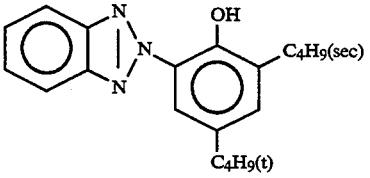
(Solv-1) Solvent:
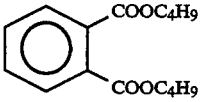
(Solv-2) Solvent:
1/1 (by volume) mixture of the following compounds:
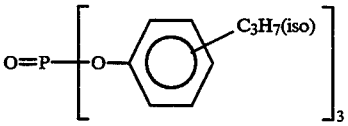
and -continued

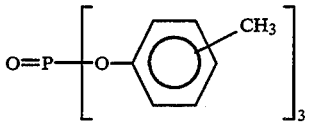

(Solv-3) Solvent:

$O{=}P{+}O{-}C_9H_{19}(iso)]_3$ (Solv-4) Solvent:

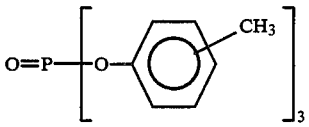

(Solv-5) Solvent:

$COOC_8H_{17}$
|
$(CH_2)_8$
|
$COOC_8H_{17}$ (Solv-6) Solvent:
80/20 (by volume) mixture of the following compounds:

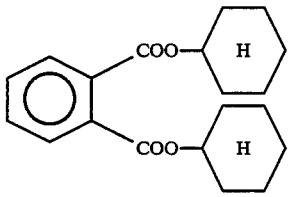

and $C_8H_{17}CHCH(CH_2)_7COOC_8H_{17}$
O (Solv-7) Solvent:

$C_8H_{17}CHCH(CH_2)_7COOC_8H_{17}$
O (S-2):

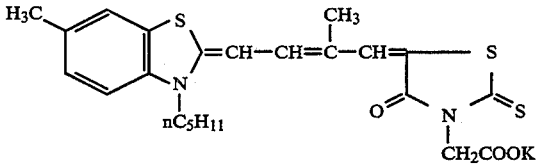

Samples Nos. 2 to 12 were prepared in the same manner as in preparation of Sample No. 1, except that the emulsion and the color sensitizing dye in the Fifth Layer (red-sensitive emulsion layer) were replaced by those shown in Table 1 below.

In order to examine the photographic properties of these samples, they were subjected to the following processing.

Each sample was wedgewise exposed for sensitometry for 1/10 second using a sensitometer (FWH Model manufactured by Fuji Photo Film Co., Ltd, with a light source having a color temperature of 3200° K.) with a red filter as inserted therebetween. The exposed samples were then processed with an automatic developing machine in accordance with the processing procedure described below, using the processing solutions also described below. The composition of the color developer was varied as shown in Table 1 below.

In addition, the indicated color developer was stored at room temperature for 2 weeks with an opening ratio (opening area/liquid capacity) of 0.02 $cm^{-1}$, and the samples were processed in the same manner with the stored (aged) color developer.

| Processing Step | Temperature | Time |
|---|---|---|
| Color Development | 35° C. | 45 seconds |
| Bleach-Fixation | 30 to 35° C. | 45 seconds |

-continued

| Processing Step | Temperature | Time |
|---|---|---|
| Rinsing (1) | 30 to 35° C. | 20 seconds |
| Rinsing (2) | 30 to 35° C. | 20 seconds |
| Rinsing (3) | 30 to 35° C. | 20 seconds |
| Drying | 70 to 80° C. | 60 seconds |

The compositions of the processing solutions used were as follows.

| | |
|---|---|
| Color Development: | |
| Water | 800 ml |
| Ethylenediamine-N,N,N',N'-tetra-methylenephosphonic Acid | 1.5 g |
| Potassium Bromide | See Table 1 |
| Triethanolamine | 8.0 g |
| Sodium Chloride | See Table 1 |
| Potassium Carbonate | 25 g |
| N-Ethyl-N-(β-methanesulfon-amidoethyl)-3-methyl-4-aminoaniline Sulfate | 5.0 g |
| N,N-bis(Carboxymethyl)hydrazine | 4.0 g |
| N,N-Di(sulfoethyl)hydroxylamine/1 Na | 4.0 g |
| Brightening Agent (WHITEX 4B, product of Sumitomo Chemical Co.) | 1.0 g |
| Water to make | 1000 ml |
| pH (25° C.) | 10.05 |
| Bleach-Fixing Solution: | |
| Water | 400 ml |
| Ammonium Thiosulfate (700 g/l) | 100 ml |
| Sodium Sulfite | 17 g |
| Ammonium Ethylenediamine-tetraacetato/Iron (III) | 55 g |
| Disodium Ethylenediaminetetraacetate | 5 g |
| Ammonium Bromide | 40 g |
| Water to make | 1000 ml |

-continued

| | |
|---|---|
| pH (25° C.) | 6.0 |
| Rinsing Solution: | |
| Ion-exchange Water (having a calcium content of 3 ppm or less and a magnesium content of 3 ppm or less). | |

The cyan color density of each of the thus processed samples was measured and the characteristic curve of each sample was obtained.

To evaluate the fluctuation of photographic properties caused by processing with a fatigued color developer, the sensitivity fluctuation (ΔS) and the density fluctuation (ΔD) were determined. The sensitivity fluctuation is represented by the difference in the logarithmic value of the exposure amount necessary for a density higher than the fog density by 0.5. A positive value means desensitization due to fatigued developer occurred. Regarding the density fluctuation, the density obtained by an exposure amount higher than the exposure amount necessary for a density of (fog density+0.5) by 0.5 log E was determined for the fresh developer and for the fatigued developer, and the difference between the two values thus determined (one for the fresh developer, and the other for the fatigued developer) was obtained as the density fluctuation. A positive value for the density fluctuation obtained means that the sample as processed with fatigued developer was softened more than that processed with fresh developer. In addition, the fog density ($D_{min}$) of the sample as processed with fatigued developer was also determined. The results thus obtained are shown in Table 1 below.

TABLE 1

| Sample | Composition of Red-Sensitive Layer: Emulsion | Composition of Red-Sensitive Layer: Color sensitizing dye | Chloride Ion in Developer Content (mol/l) | Bromide Ion in Developer Content (mol/l) | $D_{min}$ | ΔS | ΔD | Remarks |
|---|---|---|---|---|---|---|---|---|
| 1 | A | S-1 | $6 \times 10^{-2}$ | $1 \times 10^{-4}$ | 0.11 | 0.10 | 0.12 | Comparative sample |
| 2 | A | I-3 | $6 \times 10^{-2}$ | $1 \times 10^{-4}$ | 0.11 | 0.05 | 0.05 | Sample of the Invention |
| 3 | B | S-1 | $6 \times 10^{-2}$ | $1 \times 10^{-4}$ | 0.11 | 0.08 | 0.11 | Comparative sample |
| 4 | B | I-3 | $6 \times 10^{-2}$ | $1 \times 10^{-4}$ | 0.11 | 0.05 | 0.04 | Sample of the Invention |
| 5 | C | S-1 | $6 \times 10^{-2}$ | $1 \times 10^{-4}$ | 0.10 | 0.14 | 0.15 | Comparative sample |
| 6 | C | I-3 | $6 \times 10^{-2}$ | $1 \times 10^{-4}$ | 0.10 | 0.12 | 0.13 | Comparative sample |
| 7 | D | S-1 | $6 \times 10^{-2}$ | $1 \times 10^{-4}$ | 0.10 | 0.08 | 0.11 | Comparative sample |
| 7 | D | S-1 | $7 \times 10^{-3}$ | $1 \times 10^{-4}$ | 0.14 | 0.09 | 0.12 | Comparative sample |
| 7 | D | S-1 | $3 \times 10^{-1}$ | $1 \times 10^{-4}$ | 0.10 | 0.10 | 0.18 | Comparative sample |
| 7 | D | S-1 | $6 \times 10^{-2}$ | 0 | 0.17 | 0.06 | 0.11 | Comparative sample |
| 7 | D | S-1 | $6 \times 10^{-2}$ | $2 \times 10^{-3}$ | 0.10 | 0.08 | 0.16 | Comparative sample |
| 8 | D | S-2 | $6 \times 10^{-2}$ | $1 \times 10^{-4}$ | 0.10 | 0.07 | 0.12 | Comparative sample |
| 9 | D | I-3 | $6 \times 10^{-2}$ | $1 \times 10^{-4}$ | 0.10 | 0.03 | 0.03 | Sample of the Invention |
| 9 | D | I-3 | $7 \times 10^{-3}$ | $1 \times 10^{-4}$ | 0.14 | 0.04 | 0.05 | Comparative sample |
| 9 | D | I-3 | $3 \times 10^{-3}$ | $1 \times 10^{-4}$ | 0.10 | 0.08 | 0.14 | Comparative sample |
| 9 | D | I-3 | $6 \times 10^{-2}$ | 0 | 0.18 | 0.04 | 0.11 | Comparative sample |
| 9 | D | I-3 | $6 \times 10^{-2}$ | $2 \times 10^{-3}$ | 0.10 | 0.09 | 0.10 | Comparative sample |
| 10 | D | I-6 | $6 \times 10^{-2}$ | $1 \times 10^{-4}$ | 0.10 | 0.03 | 0.04 | Sample of the Invention |
| 11 | D | I-22 | $6 \times 10^{-2}$ | $1 \times 10^{-4}$ | 0.10 | 0.03 | 0.05 | Sample of |

TABLE 1-continued

| Sample | Composition of Red-Sensitive Layer: Emulsion | Color sensitizing dye | Chloride Ion in Developer Content (mol/l) | Bromide Ion in Developer Content (mol/l) | $D_{min}$ | ΔS | ΔD | Remarks |
|---|---|---|---|---|---|---|---|---|
| 12 | D | I-32 | $6 \times 10^{-2}$ | $1 \times 10^{-4}$ | 0.10 | 0.04 | 0.04 | the Invention Sample of the Invention |

Regarding $D_{min}$, ΔS and ΔD, smaller values indicate that the variation of photographic properties is smaller in continuous processing.

As is obvious from the results shown in Table 1 above, the comparative samples containing a color sensitizing agent outside the scope of the present invention showed a large fluctuation in photographic properties when processed with fatigued color developer. In contrast, the samples containing a color sensitizing agent of the present invention were free from fluctuation in photographic properties even when processed with fatigued color developer. The effect could not be obtained when the samples contained a high silver bromide emulsion. In addition, fog of the samples processed with fatigued color developer as well fluctuation of photographic properties of the samples processed with fatigued color developer could effectively be prevented only when the color developer had a chloride ion concentration and a bromide ion concentration both within the scope of the present invention.

EXAMPLE 2

32 g of a lime-processed gelatin was added to 1000 cc of distilled water and dissolved at 40° C., 1.6 g of sodium chloride was added thereto, and the temperature of the resulting solution was increased to 54° C. To the solution was added 1.7 cc of an aqueous 1% solution of N,N'-dimethylimidazolidine-2-thione. Next, a solution of 32.0 g of silver nitrate dissolved in 200 cc of distilled water and a solution of 11.0 g of sodium chloride dissolved in 200 cc of distilled water were added, with blending, to the previously prepared solution over a period of 14 minutes at 54° C. Further, a solution of 48.0 g of silver nitrate dissolved in 210 cc of distilled water and a solution of 16.5 g of sodium chloride dissolved in 210 cc of distilled water were added thereto, with stirring, over a period of 15 minutes at 54° C. Further, a solution of 80.0 g of silver nitrate dissolved in 350 cc of distilled water and a solution of 27.5 g of sodium chloride dissolved in 350 cc of distilled water were added thereto, with stirring, over a period of 25 minutes at 54° C. The resulting emulsion was desalted and washed with water at 40° C., 90.0 g of a lime-processed gelatin was added thereto, and sodium chloride and sodium hydroxide were added thereto whereby the pAg and pH of the emulsion were adjusted to 8.1 and 6.0, respectively. The emulsion was heated to 46° C., and $6 \times 10^{-5}$ mol per mol of silver halide of red-sensitizing dye (S-1) was added thereto. An emulsion of ultra-fine silver bromide grains (having a grain size of 0.05 μm) was added thereto in an amount of 0.55 mol %, with respect to the silver chloride, of silver bromide, and the resulting emulsion blend was ripened for 25 minutes. Subsequently, this was optimally sulfur-sensitized with triethylthiourea at 46° C. The silver chlorobromide emulsion (having a silver bromide content of 0.55 mol %) thus obtained was designated Emulsion (E).

Emulsion (F) (silver chlorobromide emulsion) was prepared in the same manner as in preparation of Emulsion (E), except that the red-sensitizing dye was replaced by (I-3).

Emulsion (G) (silver chlorobromide emulsion) was prepared in the same manner as in preparation of Emulsion (F), except that $1.1 \times 10^{-4}$ mol, per mol of silver bromide, of potassium hexachloroiridate(IV) was previously added to the emulsion of ultra-fine silver bromide grains to be added prior to sulfur sensitization and thereafter the resulting emulsion blend was optimally sulfur-sensitized in the same manner.

All three Emulsions (E) through (G) contained cubic grains having a mean grain size of 0.52 μm and a grain size distribution of 0.10. From the electromicrophotographs of Emulsions (E), (F) and (G), the cubic grains of each emulsion were found to have a shape with sharp corners. The X-ray diffraction analyses of these emulsions showed a weak diffraction in the part corresponding to the silver bromide content of from 10 mol % to 50 mol %. From these facts, these emulsions were determined to contain cubic silver chlorobromide grains having a silver bromide localized phase with a silver bromide content of from 10 mol % to 50 mol % on the corners of the cubic silver chloride grain (host grain), the localized phase having been grown by epitaxial growth.

Samples Nos. 13, 14 and 15 were prepared in the same manner as in preparation of Sample No. 1 of Example 1, except that only the emulsion in the Fifth Layer (red-sensitive layer) was replaced by an emulsion as shown in Table 2 below.

These samples were exposed in the same manner as in Example 1, and the exposed samples were then continuously processed with a processing machine in accordance with the processing procedure described below, using the processing solutions also described below, until the amount of the replenisher to the color developer tank became two times the capacity of the tank.

| Processing Steps | Processing Steps: Temperature | Time | Replenisher (*) | Capacity of Tank |
|---|---|---|---|---|
| Color Development | 35° C. | 45 sec | 161 ml | 17 liters |
| Bleach-fixation | 30 to 35° C. | 45 sec | 215 ml | 17 liters |
| Rinsing (1) | 30 to 35° C. | 20 sec | — | 10 liters |
| Rinsing (2) | 30 to 35° C. | 20 sec | — | 10 liters |
| Rinsing (3) | 30 to 35° C. | 20 sec | 350 ml | 10 liters |
| Drying | 70 to 80° C. | 60 sec | | |

(*) Amount of replenisher is per $m^2$ of sample being processed.

(Rinsing was effected by a three-tank counter-current system from rinsing tank (3) to rinsing tank (1).)

The processing solutions used in the above-mentioned steps had the following compositions.

Tank

-continued

| | Solution | Replenisher |
|---|---|---|
| Color developer | | |
| Water | 800 ml | 800 ml |
| Ethylenediamine-N,N,N',N'-tetramethylenephosphonic Acid | 1.5 g | 2.0 g |
| Potassium Bromide | $5 \times 10^{-5}$ mol | — |
| Triethanolamine | 8.0 g | 12.0 g |
| Sodium Chloride | $5 \times 10^{-2}$ mol | — |
| Potassium Carbonate | 25 g | 25 g |
| N-ethyl-N-(β-methanesulfonamidoethyl)-3-methyl-4-aminoaniline Sulfate | 5.0 g | 7.0 g |
| N,N-bis(Carboxymethyl)-hydrazine | 4.0 g | 5.0 g |
| N,N-Di(sulfoethyl)hydroxylamine/1 Na | 4.0 g | 5.0 g |
| Brightening Agent (WHITEX 4B, product of Sumitomo Chemical Co.) | 1.0 g | 2.0 g |
| Water to make | 1000 ml | 1000 ml |
| pH (25° C.) | 10.05 | 10.45 |
| Bleach-fixing Solution: | | |
| (Tank solution and replenisher were same.) | | |
| Water | | 400 ml |
| Ammonium Thiosulfate (700 g/l) | | 100 ml |
| Sodium Sulfite | | 17 g |
| Ammonium Ethylenediamine tetraacetato/Iron (III) | | 55 g |
| Disodium Ethylenediaminetetraacetate | | 5 g |
| Ammonium Bromide | | 40 g |
| Water to make | | 1000 ml |
| pH (25° C.) | | 6.0 |
| Rinsing Solution: | | |
| (Tank solution and replenisher were same.) | | |
| Ion-exchange Water (having calcium content of 3 ppm or less and magnesium content of 3 ppm or less). | | |

For the purpose of evaluating the fluctuation of photographic properties arising due to continuous processing, the sensitivity fluctuation (ΔS) and the density fluctuation (ΔD) were determined. The sensitivity fluctuation is represented by the difference in the logarithmic value of the exposure amount necessary for a density higher than the fog density by 0.5 between the sample as processed at the start of the continuous processing and the sample as processed at the end of the continuous processing. A positive value means desensitization due to continuous processing occurred. Regarding the density fluctuation, the density value obtained by an exposure amount higher than the exposure amount necessary for a density of (fog density+0.5) by 0.5 log E was determined for the sample as processed at the start of the continuous processing and for the sample as processed at the end of the continuous processing, and the difference between the two values thus determined was considered the density fluctuation. The positive value of density fluctuation means that the sample as processed at the end of the continuous processing was softened more than that processed at the start of the continuous processing. In addition, the fog density ($D_{min}$) of the sample processed at the end of the continuous processing was also determined. The results thus obtained are shown in Table 2 below.

TABLE 2

| Sample | Composition of Red-sensitive Layer: Emulsion | Color Sensitizing Dye | $D_{min}$ | ΔS | ΔD | Remarks |
|---|---|---|---|---|---|---|
| 13 | E | S-1 | 0.10 | 0.09 | 0.21 | Comparative sample |
| 14 | F | I-3 | 0.10 | 0.04 | 0.07 | Sample of the invention |
| 15 | G | I-3 | 0.10 | 0.03 | 0.03 | Sample of the Invention |

Regarding Dmin, ΔS and ΔD, smaller values indicate that the fluctuation of the photographic properties is smaller in continuous processing.

As is obvious from the results in Table 2 above, the comparative samples containing a color sensitizing agent outside the scope of the present invention showed a large fluctuation in photographic properties in continuous processing. In contrast, the samples containing a color sensitizing agent of the present invention were free from fluctuation of photographic properties in continuous processing. In addition, fluctuation of photographic properties in continuous processing could be inhibited extremely effectively in the case of using an iridium compound-containing silver halide emulsion.

In accordance with the image forming method of the present invention, a high silver chloride photographic material may be processed well by rapid processing while retarding fog of the processed material. The material may also be processed well even with fatigued color developer and in continuous processing with marked reduction in fluctuation of the sensitivity and gradation of the processed material.

While the invention has been described in detail and with reference to specific embodiments thereof, it will be apparent to one skilled in the art that various changes and modifications can be made therein without departing from the spirit and scope thereof.

What is claimed is:

1. A method of forming a photographic image comprising imagewise exposing a silver halide color photographic material comprising a support having thereon a cyan color image forming layer, a magenta color image forming layer and a yellow color image forming layer, wherein the cyan color image forming layer in the photographic material contains silver halide emulsion grains having a silver chloride content of 95 mol % or more and containing substantially no silver iodide and contains a color sensitizing dye of the following general formula (I):

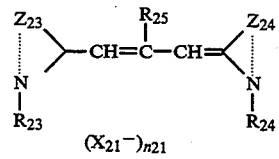

(I)

wherein $Z_{23}$ and $Z_{24}$ independently represent an atomic group necessary for forming a heterocyclic nucleus selected from the group consisting of a benzothiazole nucleus, a benzoselenazole nucleus, a naphthothiazole nucleus and a naphthoselenazole nucleus, which may optionally be substituted by at least one substituent selected from the group consisting of a halogen atom, an alkyl group, an alkoxy group, an aryl group and a hydroxyl group, and two alkyl groups of the substituents, if any, may combine and form a ring; $R_{25}$ represents a hydrogen atom, an alkyl group or an aryl group;

$R_{23}$ and $R_{24}$ independently represent a substituted or unsubstituted alkyl group;

$X_{21}$ represents an ion; and $n_{21}$ represents 0 or 1, and color developing the exposed material with a color developer, wherein the color developer has a chloride ion content of from $3.5\times10^{-2}$ to $1.5\times10^{-1}$ mol/liter and a bromide ion content of from $1.5\times10^{-5}$ to $1.0\times10^{-3}$ mol/liter; wherein an iridium compound is contained in a silver bromide localized phase of the silver halide emulsion grains.

2. The method of forming a photographic image as in claim 1, wherein the silver halide emulsion grains in the cyan color image forming layer of the photographic material contain a silver bromide localized phase in an amount of more than 10 mol % as silver bromide content in the localized phase.

3. The method of forming a photographic image as in claim 1, wherein the iridium compound is contained in an amount of from $10^{-9}$ mol to $10^{-6}$ mol per mol of silver halide in the emulsion.

4. The method of forming a photographic image as in claim 1, wherein the iridium compound is selected from the group consisting of hexachloroiridates(III) or (IV), hexamineiridates(III) or (IV), and trioxalatoiridates(III) or (IV).

5. The method of forming a photographic image as in claim 1, wherein chloride ion content in the color developer is from $4\times10^{-2}$ to $1\times10^{-1}$ mol/liter.

6. The method of forming a photographic image as in claim 1, wherein bromide ion content in the color developer is from $2\times10^{-5}$ to $5\times10^{-4}$ mol/liter.

* * * * *